US010631675B1

(12) United States Patent
Ellsworth et al.

(10) Patent No.: US 10,631,675 B1
(45) Date of Patent: Apr. 28, 2020

(54) COMBINATION LID AND STRAW FOR A DRINKING CONTAINER

(71) Applicant: Ingeniri, LLC, Long Beach, CA (US)

(72) Inventors: Sky Ellsworth, Long Beach, CA (US); Daniel Massie, Mission Viejo, CA (US); Claire Massie, Mission Viejo, CA (US); Satish Yalamanchili, Irvine, CA (US)

(73) Assignee: Ingeniri, LLC, Long Beach, CA (US)

( * ) Notice: Subject to any disclaimer, the term of this patent is extended or adjusted under 35 U.S.C. 154(b) by 715 days.

(21) Appl. No.: 14/800,262

(22) Filed: Jul. 15, 2015

Related U.S. Application Data

(63) Continuation-in-part of application No. 14/497,300, filed on Sep. 25, 2014, now Pat. No. 9,668,599.
(Continued)

(51) Int. Cl.
*A47G 19/22* (2006.01)
*A47G 21/18* (2006.01)
(Continued)

(52) U.S. Cl.
CPC ..... *A47G 19/2222* (2013.01); *A47G 19/2272* (2013.01); *A47G 21/18* (2013.01);
(Continued)

(58) Field of Classification Search
CPC .... B65D 51/24; B65D 51/16; B65D 51/1672; A47G 19/2227; A47G 19/2222;
(Continued)

(56) References Cited

U.S. PATENT DOCUMENTS 2,223,179 A 8/1937 Lougheed
2,110,026 A * 3/1938 Rose ..... B65D 47/061 215/309
(Continued)

FOREIGN PATENT DOCUMENTS

CA 2470298 9/2009
EP 1537030 6/2005
(Continued)

*Primary Examiner* — Andrew D Perreault
(74) *Attorney, Agent, or Firm* — Eric Karich; Karich & Associates

(57) ABSTRACT

A combination lid and straw for covering a drinking container has a lid, a straw having an interlocking portion, and at least one venting slot. The lid has a lid perimeter adapted to be attached to the drinking container, and a straw aperture having an inner surface. The interlocking portion of the straw is shaped to interlock with the straw aperture to resist movement of the straw relative to the lid. The venting slots are formed between the inner surface of the straw aperture of the lid, and the outer surface of the straw. Each of the venting slots has a diameter that is large enough to allow air to vent into the container, but small enough to restrict liquid from leaking from the container. The drinking straw has a proximal and distal end. One or both ends may be shaped to prevent a water droplet from leaking from the drinking straw. The drinking straw body may have flexibility and a specific gravity greater than 1 so that when the container is held in a non-vertical orientation, the distal end of the elongate straw body remains submerged in the fluid within the container, without the addition of weights to the distal end of the straw body.

4 Claims, 10 Drawing Sheets

Related U.S. Application Data

(60) Provisional application No. 61/960,706, filed on Sep. 25, 2013.

(51) Int. Cl.
*B65D 47/32* (2006.01)
*B65D 51/16* (2006.01)
*B65D 51/24* (2006.01)

(52) U.S. Cl.
CPC ..... *B65D 47/32* (2013.01); *B65D 51/16* (2013.01); *B65D 51/24* (2013.01)

(58) Field of Classification Search
CPC .... A47G 19/22; A47G 19/2266; A47G 21/18; A47G 19/2272; A63H 33/40
USPC ..... 220/703, 705, 707; 446/74, 200, 199, 446/201, 202, 217, 218
See application file for complete search history.

(56) References Cited

U.S. PATENT DOCUMENTS

| | | | | |
|---|---|---|---|---|
| 3,253,726 | A | 5/1966 | Meierhoefer | |
| 4,196,747 | A | 4/1980 | Quigley et al. | |
| 4,607,755 | A | 8/1986 | Andreozzi | |
| 4,927,062 | A | 5/1990 | Walsh | |
| 5,031,831 | A | 7/1991 | Williams, III | |
| 5,085,349 | A | 2/1992 | Fawcett | |
| 5,105,975 | A | 4/1992 | Patterson | |
| 5,284,261 | A | 2/1994 | Zambuto | |
| 5,873,474 | A | 2/1999 | Gray | |
| 5,934,519 | A | 8/1999 | Kim | |
| 5,988,448 | A * | 11/1999 | Foth | B65D 47/243 222/189.09 |
| 6,102,245 | A | 8/2000 | Haberman | |
| 6,116,457 | A | 9/2000 | Haberman | |
| 6,779,694 | B2 | 8/2004 | Young | |
| 6,915,961 | B2 | 7/2005 | Renz et al. | |
| 6,976,604 | B2 | 12/2005 | Connors, Jr. et al. | |
| 7,178,685 | B2 | 2/2007 | Hidalgo et al. | |
| 7,185,784 | B2 | 3/2007 | Connors, Jr. et al. | |
| 7,275,665 | B2 | 10/2007 | Young | |
| 7,516,862 | B2 | 4/2009 | McDonough | |
| 7,533,783 | B2 | 5/2009 | Choi et al. | |
| 7,748,643 | B2 | 7/2010 | Renz et al. | |
| D649,835 | S | 12/2011 | Lim | |
| 8,302,804 | B2 | 11/2012 | Seddon | |
| 9,232,870 | B2 * | 1/2016 | Wang | A47G 21/18 |
| 2004/0173556 | A1 | 9/2004 | Smolko et al. | |
| 2011/0049169 | A1 * | 3/2011 | Rosnak | A47G 19/2266 220/705 |
| 2013/0126527 | A1 * | 5/2013 | Chiu | A47G 21/18 220/212 |
| 2014/0158699 | A1 | 6/2014 | Kim | |

FOREIGN PATENT DOCUMENTS

| | | |
|---|---|---|
| EP | 1998652 | 12/2008 |
| EP | 1 537 030 | 5/2009 |
| WO | WO 2007057716 | 5/2007 |

* cited by examiner

COMBINATION LID AND STRAW FOR A DRINKING CONTAINER

CROSS-REFERENCE TO RELATED APPLICATIONS

This application for a utility patent is a continuation-in-part of a previously filed utility patent, still pending, having the application Ser. No. 14/497,300, filed Sep. 25, 2014, which claims the benefit of U.S. Provisional Application No. 61/960,706, filed Sep. 25, 2013, both of which are hereby incorporated by reference in full.

BACKGROUND OF THE INVENTION

Field of the Invention

This invention relates generally to drinking containers, and more particularly to a combination lid and straw for covering a drinking container that enables venting into the container but restricts leaking in the event the container is knocked over, and allows drinking when the cup is held in a non-vertical orientation.

Description of Related Art

Young children often lack adequate dexterity to allow for successful consumption of liquid from an open cup. To this end, a number of training cups exist having a straw designed to facilitate consumption of liquid by children or others having limited dexterity.

The inclusion of a straw can often lead to leaks if the cup is tipped or dropped, unless there is a mechanism to prevent liquid flow when not in use. This is especially a problem when the child is traveling in an automobile or the like, and drinks from such a container, especially when drinking juice or other liquid which may stain and soil the vehicle.

Valved drinking devices used as trainer cups provide a partial solution to this problem and are well known in the art. For example, U.S. Pat. Nos. 6,102,245 and 6,116,457, both to Haberman, provide for a drinking vessel having a valve contained in a lid mouthpiece.

U.S. Pat. No. 5,085,349 to Fawcett provides a fluid supply chamber connected to a length of tubing having a closed end with a deformable slit. The tube can be received in a person's mouth to enable fluid to flow therethrough.

U.S. Pat. No. 4,607,755 to Andreozzi provides a children's drinking vessel with a flexible straw disconnectably mounted on a container and extendable substantially beyond the container. The outermost free end of the straw has a valve.

U.S. Pat. No. 4,196,747 to Quigley et al. provides a drinking tube connected to a one-way valve located in a liquid reservoir. The valve has a flapper enclosed within a valve chamber to prevent liquid from flowing back from the tube into the reservoir.

U.S. Pat. No. 5,031,831 to Williams, III provides for a straw having a one-way flapper valve at the bottom of the straw to prevent liquid from falling back when the sucking action of the drinker ceases.

While the art provides for drinking straw systems that include valves, missing in the art is a drinking straw of very simple construction that does not require a valve, and which may be easily removed and cleaned.

The inclusion of a straw can often make it more difficult for children to drink from, especially when they are transitioning from a baby bottle, since a bottle our spouted cup must be tipped up to drink, whereas a straw cup must be held in a vertical orientation.

U.S. Pat. No. 5,873,474 to Gray and U.S. Pat. No. 5,934,519 to Kim et al. provide for a straw having a weighted assembly at the distal end of the straw to follow the liquid in the bottle.

While the art provides for drinking straw systems that include a weight at the end of a straw to maintain submersion when a cup is tilted, missing in the art is a drinking straw of very simple construction that does not require the additional complexity of added materials, components, or geometries, and which may be easily manufactured and cleaned.

SUMMARY OF THE INVENTION

The present invention teaches certain benefits in construction and use which give rise to the objectives described below.

The present invention provides a combination lid and straw for covering a drinking container, the combination comprising a lid, a straw having an interlocking portion, and at least one venting slot. The lid has a lid perimeter adapted to be attached to the drinking container, and a straw aperture having an inner surface. The interlocking portion of the outer surface of the straw is shaped to interlock with the straw aperture to resist movement of the straw relative to the lid. The venting slots are formed between the inner surface of the straw aperture of the lid, and the outer surface of the straw. Each of the venting slots has a diameter that is large enough to allow air to vent through the venting slots and into the container, but small enough to restrict liquid from leaking from the container.

In one embodiment, one or both of the straw ends are shaped to prevent a water droplet from leaking from the drinking straw.

In one embodiment, the straw body has a specific gravity greater than 1, and material and geometry that together provide sufficient flexibility such that when the container is held in a non-vertical orientation, the distal end of the straw body remains submerged in the fluid within the container.

A primary objective of the present invention is to provide a combination lid and straw having advantages not taught by the prior art.

Another objective is to provide a combination that is of simple and inexpensive design.

Another objective is to provide a combination that may be readily disassembled for cleaning.

Another objective is to provide a combination that is effective in resisting leaks under ordinary circumstances.

Another objective is to provide a combination that maintains the straw body submerged in fluid when the container is tilted.

A further objective is to provide a combination that is easy to assemble and use.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a combination lid and straw for use with a drinking container. The combination includes a lid and a straw that are particularly adapted to resist leaks if the container is knocked over or dropped.

Figure 1:
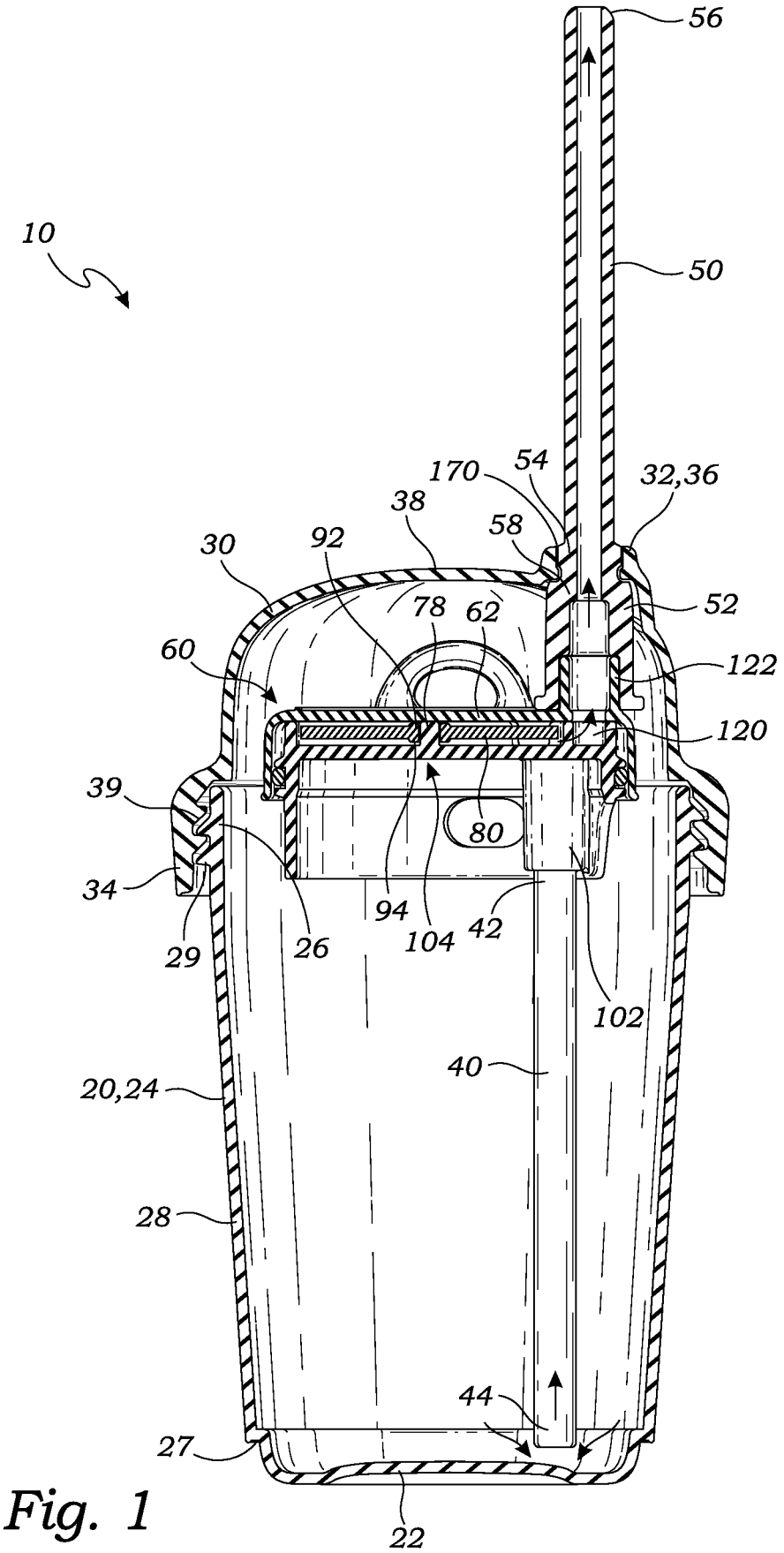
FIG. 1 is a side sectional view of a drinking container according to one embodiment of the present invention.
Figure 2:
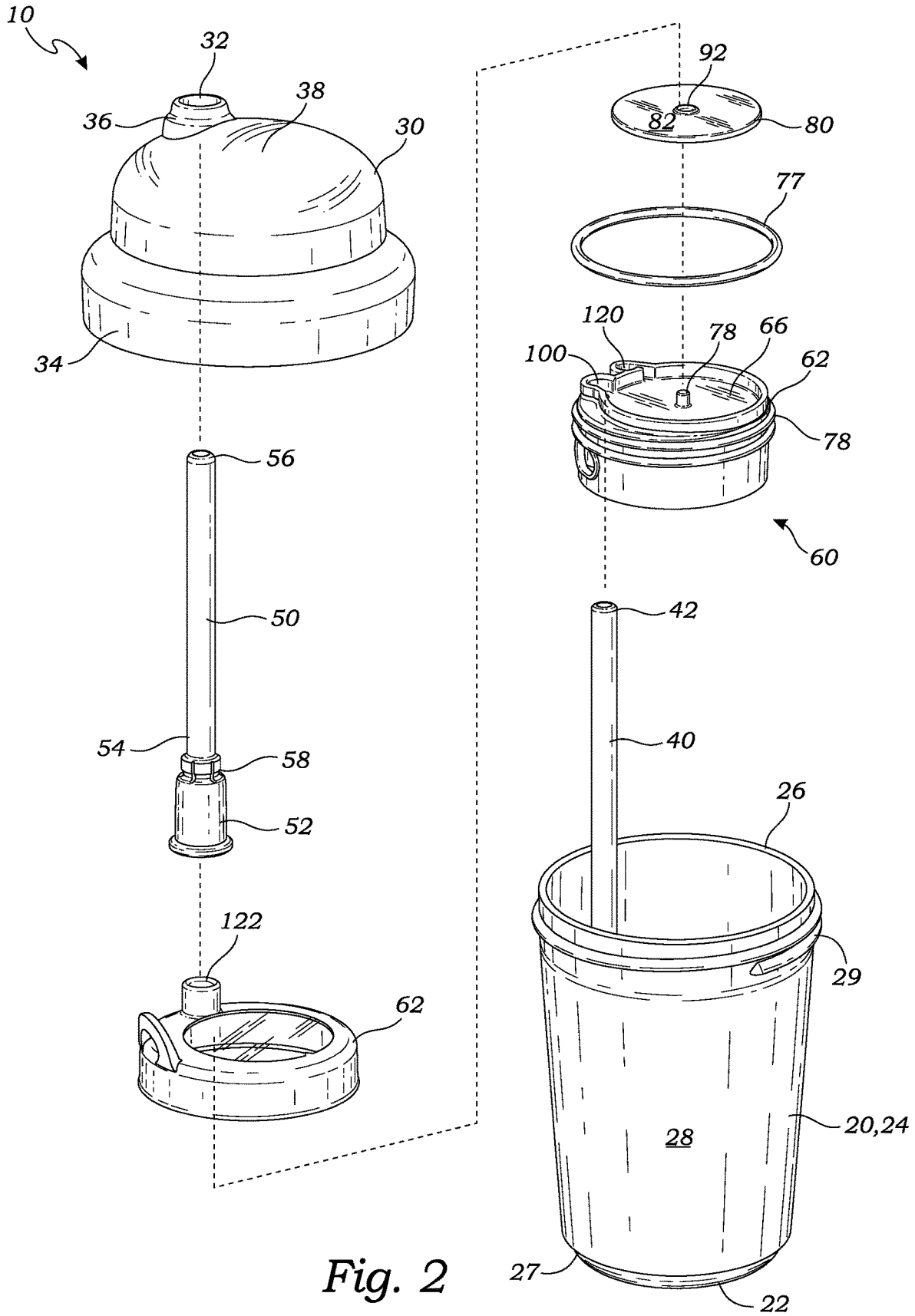
FIG. 2 is an exploded perspective view thereof.

FIG. 1 is a side sectional view of one embodiment of a drinking container 10. FIG. 2 is an exploded perspective view thereof. As shown in FIGS. 1 and 2, the drinking container 10 may include a cup 20 that is used with the lid 30, and may further include a spinner mechanism 60. The straw 50 extends through the lid 30, as discussed in greater detail below. In this embodiment, the straw 50 may further include a bottom straw 40. The cup 20 and the lid 30 are connected for holding a liquid (not shown). The spinner mechanism 60 may be mounted in the cup 20 for providing the display.

In the embodiment of FIGS. 1 and 2, the cup 20 has a cup bottom 22 and a cup wall 24 that extends upwardly to a cup perimeter 26. In the present embodiment, the cup 20 includes an outward step 27, and a conical body portion 28 of the cup wall 24 that extends upwardly above the outward step 27. The cup perimeter 26 may include threading 29, or an equivalent structure, for engaging the lid 30. While one embodiment of the drinking container 10 may have any form, shape, or additional features, including any cups that are known in the art, and such alternatives should be considered within the scope of the present invention.

In this embodiment, the lid 30 includes a straw aperture 32 through the lid 30, and a lid perimeter 34 that engages the cup perimeter 26 of the cup 20. The straw aperture 32 may include an upwardly extending flange 36, as shown, or may be an alternative construction that functions as described herein. A top surface 38 of the lid 30 may be generally flat, and may be transparent, to facilitate viewing of the spinner mechanism 60.

The lid perimeter 34 of the lid 30 may include another threading 39, or an equivalent structure, for engaging the cup 20, as mentioned above. The lid 30 preferably forms an airtight seal with the cup 20, to prevent leakage if the drinking container 10 is tipped over; however, this is not required in alternative embodiments. Since the general construction of such cups is well known in the art, these aspects of the invention are not described in greater detail herein.

While some particular embodiments of the container 10, including the cup 20, the lid 30, and the straw 50, are shown herein, the invention should not be limited to these particular embodiments, but should be construed to include any alternative embodiments that may be designed by one skilled in the art consistent with this disclosure. A wide variety of cups known in the art may be used, as well as a large number of lids 30 or equivalent constructions may be used.

The spinner mechanism 60 is adapted to spin when a person is drinking from the drinking container 10. The spinner mechanism 60 includes a liquid input 100 and a liquid outlet 120 for receiving the liquid into the spinner mechanism 60, and then allowing the liquid out of the spinner mechanism 60. The construction of the spinner mechanism 60 is shown in greater detail in the following drawing figures, and is discussed in greater detail below.

As shown in FIGS. 1 and 2, the liquid input 100 may receive the liquid from the bottom straw 40, and the liquid outlet 120 may direct the liquid into the top straw 50, for directing the liquid into and out of the spinner mechanism 60. However, this is not required, and in alternative embodiments or arrangements these straws may be omitted or used in different configurations.

In the present embodiment, the bottom straw 40 includes a top end 42 and a bottom end 44, the top end 42 being engaged with the liquid input 100 of the spinner mechanism 60. In this embodiment, the top end 42 of the bottom straw 40 is operably engaged with the liquid input 100 of the spinner mechanism 60, via an input port 102 that extends from a bottom surface 104 of the spinner mechanism 60, such that the bottom end 44 of the bottom straw 40 extends downwardly into the cup 20 for immersion in the liquid. The input port 102 may be of tubular construction shaped to engage (e.g., frictionally, threadedly, or otherwise) the bottom straw 40. In this embodiment, the bottom straw 40 fits into and frictionally engages the input port 102. A simple frictional engagement contributes to quick and easy assembly and disassembly for cleaning and storage. While one embodiment of such engagement is shown herein, those skilled in the art may devise alternative engagement structures, and such alternatives should be considered within the scope of the present invention.

In this embodiment, the top straw 50 has a proximal end 52, a middle tubular body 54, and a distal end. The proximal end 52 of the top straw 50 may be engaged with the liquid outlet 120 of the spinner mechanism 60, in this case via a outlet port 122 that may be of generally tubular construction. In this embodiment, the top straw 50 extends through the straw aperture 32 of the top lid so that the distal end 56 extends from the drinking container 10. In this embodiment, the middle tubular body 54 includes a lid engagement structure 58 that engages the straw aperture 32 of the lid 30 so that the top straw 50 is fixed relative to the lid 30. In this embodiment, the lid engagement structure 58 allows air flow between the top straw 50 and the lid 30, to allow venting.

Figure 3:
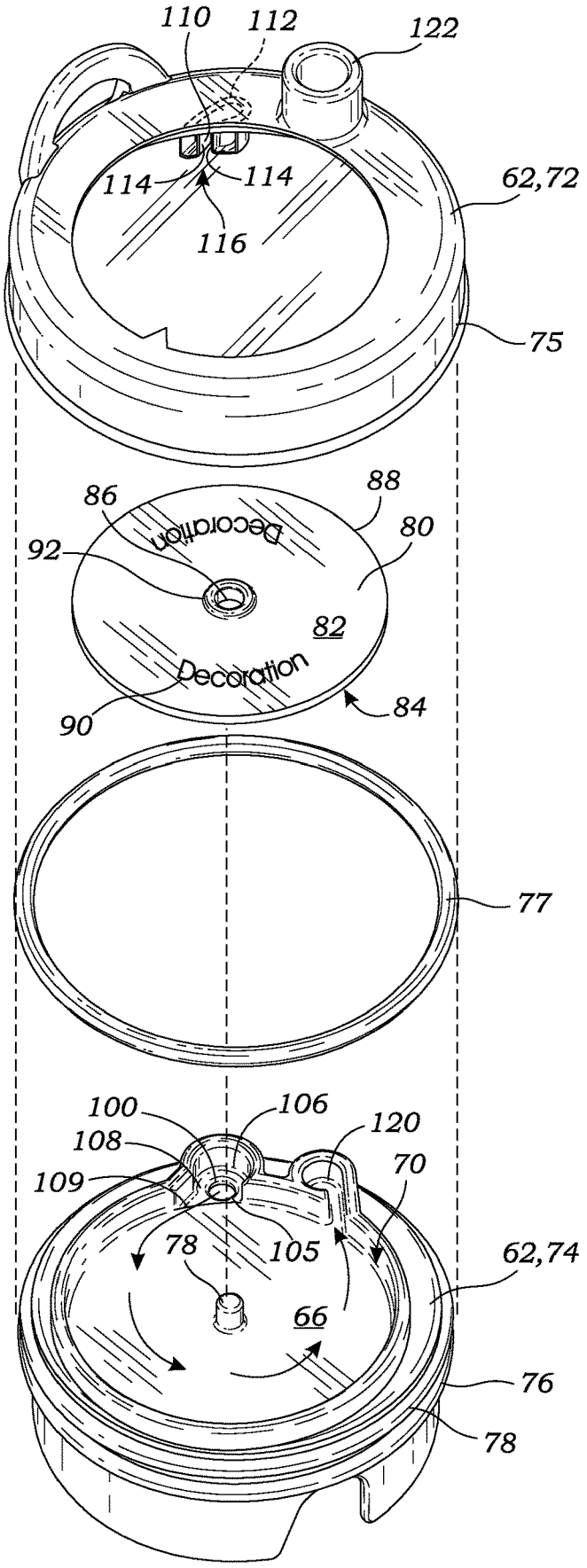
FIG. 3 is an exploded perspective view of a spinner mechanism of the drinking container of FIGS. 1 and 2.
Figure 4:
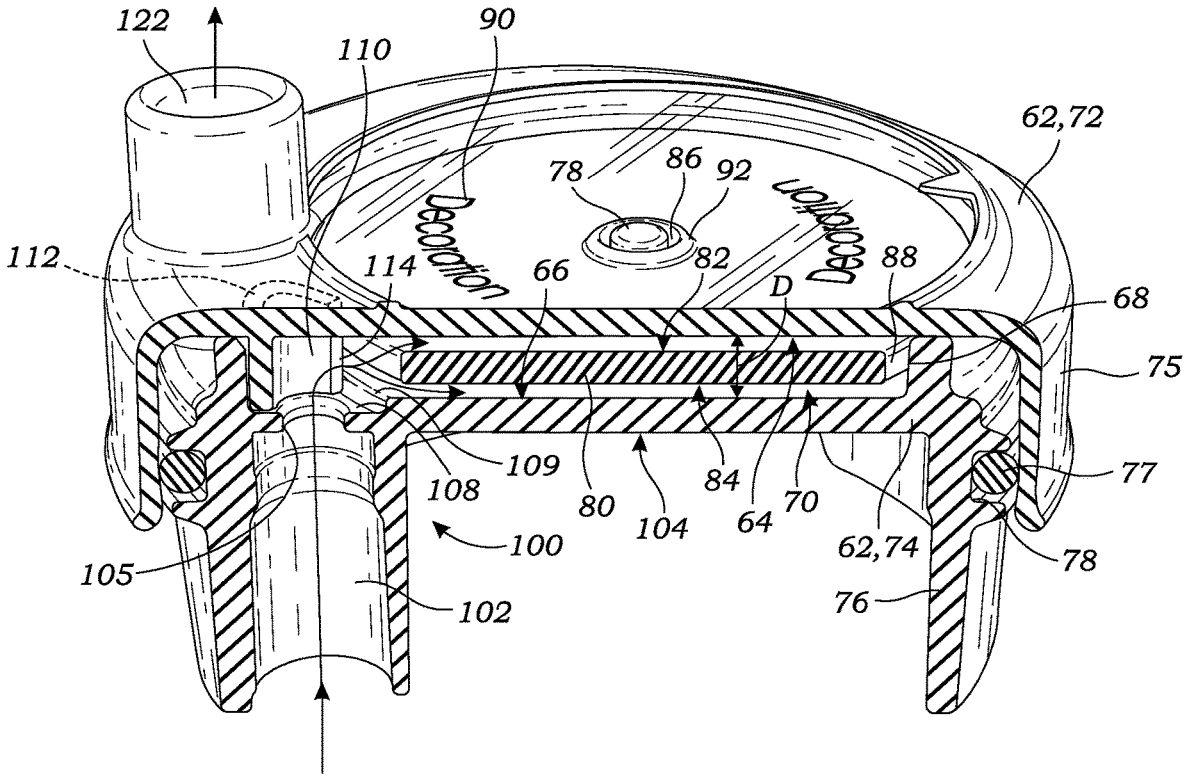
FIG. 4 is a perspective view of the spinner mechanism, with a portion of the spinner mechanism broken away to reveal the internal construction of the spinner mechanism.

FIG. 3 is an exploded perspective view of the spinner mechanism 60. FIG. 4 is a perspective view of the spinner mechanism 60, with a portion of the spinner mechanism 60 broken away to reveal the internal construction of the spinner mechanism 60. As shown in FIGS. 3 and 4, the spinner mechanism 60 includes a spinner housing 62 that forms a spinner chamber 70 that is shaped to receive a spinner disk 80. The spinner housing 62 is at least partially transparent so that the spinning of the spinner disk 80 may be observed by the person drinking from the drinking container 10.

As shown in FIGS. 3 and 4, the spinner housing 62 includes a first chamber surface 64 and a second chamber surface 66 that are spaced apart from each other a distance D by a chamber perimeter surface 68. The distance D may be consistent, or may vary, but should be sufficient to envelop the spinner disk 80 with the desired clearance, as discussed in greater detail below. The first and second chamber surfaces 64 and 66 and the chamber perimeter surface 68 together define the spinner chamber 70. In the present embodiment, the spinner housing 62 includes a first housing component 72 and a second housing component 74 that may be connected together to form the spinner housing 62. In this embodiment, the first housing component 72 includes the first chamber surface 64 and a first annular wall 75, and the second housing component 74 includes the second chamber surface 66 and a second annular wall 76. The first and second housing components 72 and 74 are pressed together around the spinner disk 80, and a connector 77 (e.g., a mechanical seal such as an O-ring, a threaded connection, or other form of connection known in the art). In the present embodiment, the first and second housing components 74 may be readily separated for cleaning; however, in some embodiments, they may be permanently connected. In this embodiment, the connector 77 is a mechanical seal such as an O-ring that is positioned between the first and second annular walls 75 and 76 (in a suitable groove, for example) for sealing and removably interlocking the first and second housing components 72 and 74, as shown.

An axle 78 extends upwardly from the second chamber surface 66 for rotatably mounting the spinner disk 80 in the spinner chamber 70. For purposes of this application, the term "axle" 78 is defined to include any form of structure that functions for rotatably mounting the spinner disk 80, and the term should be broadly construed to include alternative structures (e.g., a post, a pin, an annular wall, etc.). The terms "axle" and related terms (e.g., the center aperture, the hubs, etc.) are also expressly defined to include all inverse constructions, wherein the axle extends from the spinner disk 88 and engages a receiver (not shown) in the spinner chamber 70, or from the first chamber surface 64.

As shown in FIGS. 3 and 4, the spinner disk 80 has a top disk surface 82 and a bottom disk surface 84 that extend from a center aperture 86 to an outer disk perimeter 88. The top disk surface 82 may include decorative elements 90 that provide enjoyment and entertainment to the child (or other person) drinking from the drinking container 10. In this embodiment, the spinner disk 80 is shaped to fit securely within the spinner chamber 70 when the spinner disk 80 is mounted with the axle 78 through the center aperture 86 of the spinner disk 80. The clearance between the spinner housing 62 and the spinner disk 80 controls the velocity of the flow of the liquid, the pressure differential, as well as the volume that requires priming. This clearance should be optimized for the particular design to achieve high flow-velocity and a practical pressure differential for a given volumetric flow rate. Furthermore, the volume should be kept small to minimize the priming effort. In this embodiment, the spinner housing 62 envelops the spinner disk 80 with a nominal clearance of 0.01-0.1 inches between the first chamber surface 64 and the top disk surface 82, and between the second chamber surface 66 and the bottom disk surface 84.

In this embodiment, the top disk surface 82 and the bottom disk surface 84 of the spinner disk 80 are planar, and wherein the spinner disk 80 does not include paddles. For purposes of this application, the term "paddle" is hereby defined to include any form of paddle, vane, blade, or equivalent structure shaped to capture fluid flow. The absence of paddles enables the tight clearance between the spinner disk 80 and the spinner housing 62, which prevents undue air from mixing with the liquid, forming bubbles, and otherwise interfering with the person's drinking from the drinking container 10.

The spinner disk 80 may further include top and bottom spacers 92 and 94 extending outwardly from the top disk surface 82 and the bottom disk surface 84, respectively, which maintain a slip fit with the first and second chamber surfaces 64 and 66 to maintain space between the top and bottom disk surfaces 82 and 84 and the first and second chamber surfaces 64 and 66. The top and bottom spacers 92 and 94 may be in the form of annular hubs adjacent and around the center aperture 86.

As shown in FIGS. 3 and 4, the liquid input 100 may extend through the chamber perimeter surface 68 for directing the liquid at the spinner disk 80 for spinning the spinner disk 80. In this embodiment, the liquid input 100 is an input aperture 105 in an input chamber 106 formed in the chamber perimeter surface 68 of the spinner housing 62. The input chamber 106 has an input chamber floor 108 that is separated from the second chamber surface 64 by a step 109 so that the input chamber floor 108 is lower than the second chamber surface 66.

In this embodiment, the liquid input 100 further includes a jet nozzle 110 operably positioned adjacent the liquid input 100 for directing the liquid at the outer disk perimeter 88 so that jets of the liquid flow across the top and bottom disk surfaces 82 and 84 the spinner disk 80. The jets may be directed to follow a path that is generally circular around an axis of the spinner disk 80, to spin the spinner disk 80. In this embodiment, the jet nozzle 110 is a generally C-shaped wall extending downwardly from the first chamber surface 64 to fit within the input chamber 106, such that two ends 114 are positioned adjacent each other to form a restricted outlet 116. The restricted outlet 116 increases the velocity of the liquid when it enters the spinner chamber 70. While the C-shaped configuration is used in the present embodiment, the jet nozzle 110 may be any shape that produces a suitable jet of the liquid (e.g., round or slotted tube or orifice, nozzle, or other duct, etc.) when the liquid flows into the spinner housing 62 through the fluid input 100.

As shown in FIGS. 3 and 4, the spinner mechanism 60 further includes a liquid outlet 120 for allowing the liquid out of the spinner chamber 70 once it has contacted the spinner disk 80. The liquid outlet 120 may further include an outlet port 122 that engages (e.g., frictionally, threadedly, etc.) the top straw 50. In the present embodiment, both the top and bottom straws are constructed of a resilient material (e.g., plastic, rubber, elastomer, etc.) that can easily frictionally fit into or around a port or similar structure, for quick assembly and disassembly.

During use, the drinking container 10 is assembled, as shown in FIG. 1, and at least partially filled with the liquid that is to be consumed. When suction is applied to the top straw 50, the liquid is drawn up the bottom straw 40 by the pressure differential, through the jet nozzle 110, and sprayed into the spinner chamber 70 as described above. The liquid jets are directed across the spinner disk 80 as discussed above, such that the liquid jets flow across the top and bottom disk surfaces 82 and 84, around the axle 78 in a generally circular path, and then exit through the fluid outlet 120, and up the top straw 50.

The high speed fluid jet imparts viscous forces to the lower speed fluid surrounding it, acting to slow the fluid jet and speed the surrounding fluid. In accordance with the well-known "no slip" condition, adhesive forces between the fluid and the spinner disk 80 ensure that the fluid layer in direct contact with the spinner disk 80 has the same velocity as the spinner disk 80. So, the kinetic energy of the fluid jets is imparted to the spinner disk 80 through viscous and adhesive forces, promoting rotation of the spinner disk 80.

As the user drinks through the top straw 50, he or she can see the spinner disk 80 rotate (along with any decorative features 90 printed on or formed on the spinner disk 80), in an entertaining manner. The rate of spin varies depending upon the suction power applied by the user.

Figure 5:
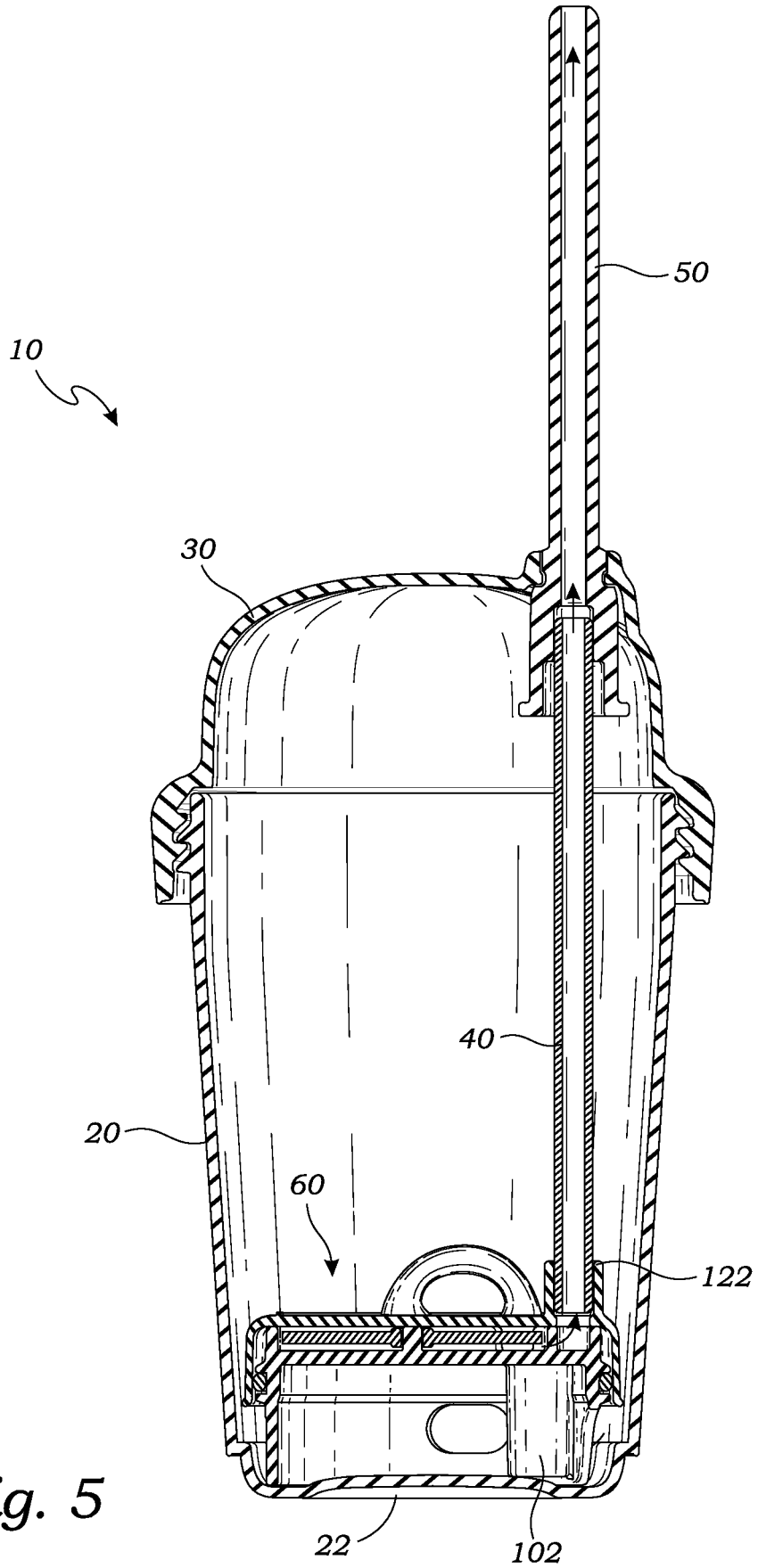
FIG. 5 is a side sectional view of a the drinking container illustrating another method of assembling the drinking container.

FIG. 5 is a side sectional view of the drinking container 10 illustrating another method of assembling the drinking container 10. In this arrangement, the spinner mechanism 60 is positioned elsewhere in or on the drinking container 10, in this case, in a bottom portion of the drinking container 10 adjacent the cup bottom 22. In this arrangement, the input port 102 is able to draw the liquid from the cup 20, and the top and bottom straws 50 and 40 are connected together to extend from the outlet port 122 up to and through the lid 30. While this illustrates one embodiment of the present invention, alternative assemblies and constructions could also be used, according to the designs of one skilled in the art, and should be considered within the scope of the present invention.

Figure 6:
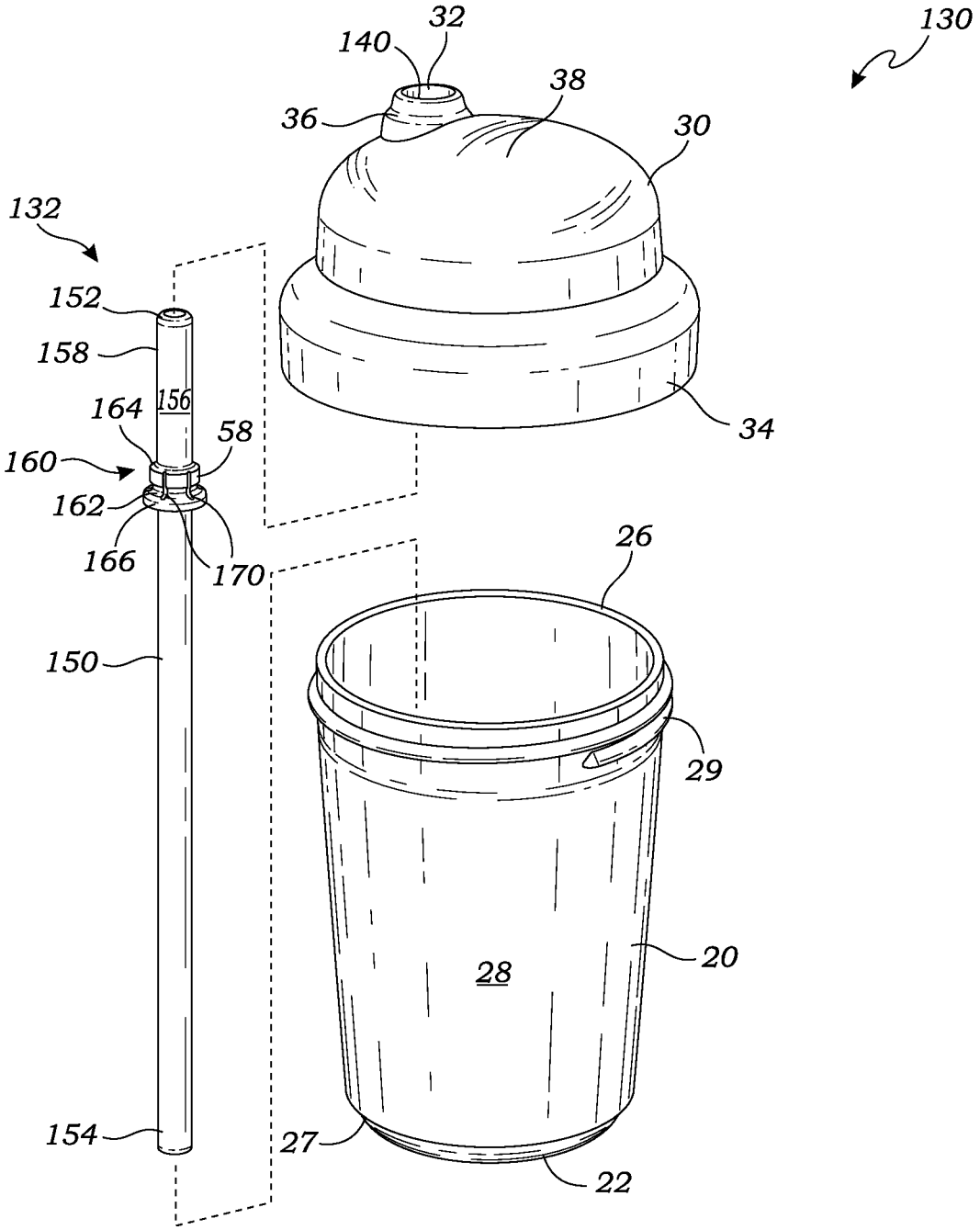
FIG. 6 is an exploded perspective view of a second embodiment of the drinking container, illustrating a second embodiment of a straw that is used in a second embodiment of the lid without the spinner described above.
Figure 7:
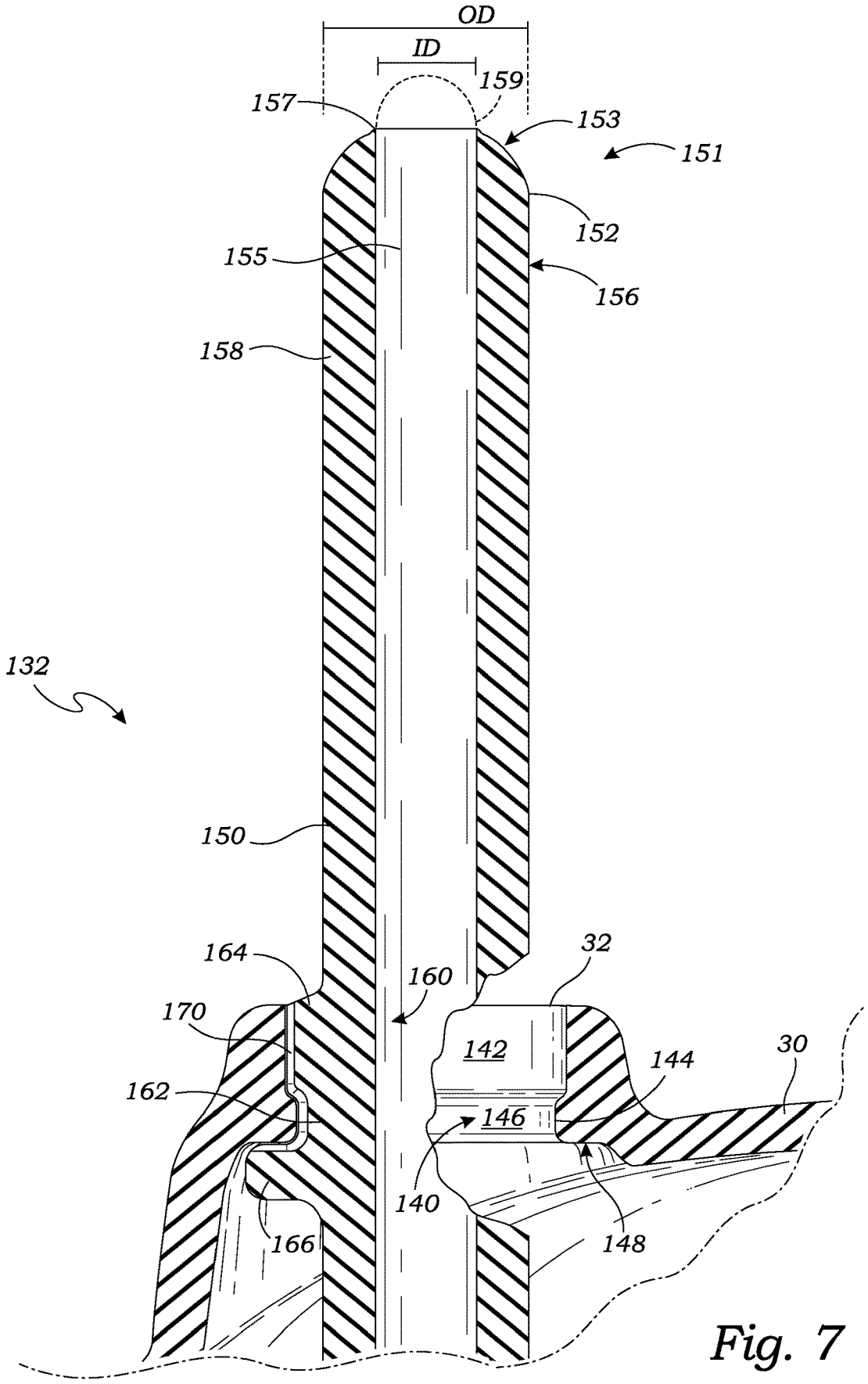
FIG. 7 is a close up cross-sectional view of one embodiment of the straw operably mounted in the lid, illustrating venting slots formed in the straw to enable venting through the lid.

FIG. 6 is an exploded perspective view of a second embodiment of the drinking container 130, illustrating a combination lid and straw 132 that includes a second embodiment of the straw 150. FIG. 7 is a close up cross-sectional view of the straw 150 operably mounted in the lid 30, with a portion of the straw 150 broken away to better illustrate an inner surface 140 of the straw aperture 32. As shown in FIGS. 6 and 7, the combination 132 may be used for covering the cup 20 to resist leakage but still enable venting of air into and out of the container 130, as needed.

As shown in FIGS. 6 and 7, in this embodiment of the combination 132, the straw 150 includes an interlocking portion 160 that is shaped to operably engage the inner surface 140 of the straw aperture 32. In the embodiment of FIGS. 6 and 7, the straw 150 includes a proximal end 152, a distal end 154, and an outer surface 156, and the interlocking portion 160 is formed in the outer surface 156 of the straw 150.

As shown in FIG. 6, the proximal end 152 or the distal end 154 of the straw 150 (or both) may include a bullet-shaped cross sectional tip 151 that is shaped to prevent a water droplet 159 from leaking from the drinking straw 150. In this embodiment, the drinking straw 150 includes an elongate straw body 158 that defines an inner conduit 155 such that the elongate straw body has an inner diameter ID and an outer diameter OD. The difference between the inner diameter ID and outer diameter OD defines a thickness of the straw 150.

The bullet-shaped cross sectional tip 151 includes a thin annular edge 157 that forms the inner diameter ID, and a tapered portion 153 extending away from the inner diameter ID to form the outer diameter OD. In this embodiment, the water droplet 159 stabilizes approximately on the thin annular edge 157 of the inner diameter ID so that the water droplet 159 has a minimized diameter and the surface tension of the water droplet prevents the water droplet 159 from escaping the drinking straw 150. For the purposes of this application, the term "thin annular edge" 157 is defined to include any form of structure that functions to stabilize the water droplet 159 on a minimized diameter, and the term should be broadly construed to include alternative structures (e.g., a sharp edge on the inner diameter ID, or a thin wall or protrusion that extends from the inner diameter ID). In prior art straws, a water droplet would tend to spread to the outer diameter OD, and thus have a larger diameter and a greater ability to overcome the surface tension of the water and drip from the straw 150.

Also shown in FIGS. 6 and 7, the interlocking portion 160 is shaped to interlock with the straw aperture 32 to resist movement of the straw 150 relative to the lid 30. In this embodiment, the interlocking portion 160 includes an annular groove 162 that is shaped to frictionally engage the inner surface 140 of the straw aperture 32. In this embodiment, the annular groove 162 is adjacent a top bushing portion 164 that extends radially outwardly from the straw 150, and a bottom bushing portion 166 that extends radially outwardly from the straw 150.

As shown in FIGS. 6 and 7, in this embodiment the inner surface 140 of the straw aperture 32 includes an inner conduit surface 142 adjacent an inwardly extending locking portion 144 that extends inwardly from the inner surface 140. In this embodiment, the inner conduit surface 142 has a generally annular cross-section and is shaped to abut the top bushing portion 164.

In this embodiment, the interlocking portion 160 includes at least one venting slot 170, typically a plurality of the venting slots 170, that traverse at least part of the interlocking portion 160 to enable air to vent into the container 130 while preventing, or at least resisting, leakage. The venting slots 170 are formed between the inner surface 140 of the straw aperture 32 of the lid 30, and the outer surface 156 of the straw 150. The venting slots 170 each have a diameter that is large enough to allow air to vent through the venting slots 170, but small enough to restrict liquid from leaking from the container 130.

In the embodiment of FIGS. 6 and 7, the venting slots 170 are formed in the straw 150, and extend across the annular groove 162, the top bushing portion 164, and the bottom bushing portion 166. In alternative embodiments, alternative constructions may be designed by one skilled in the art which enable the venting described herein, and such alternatives should be considered within the scope of the present invention.

Figure 8:
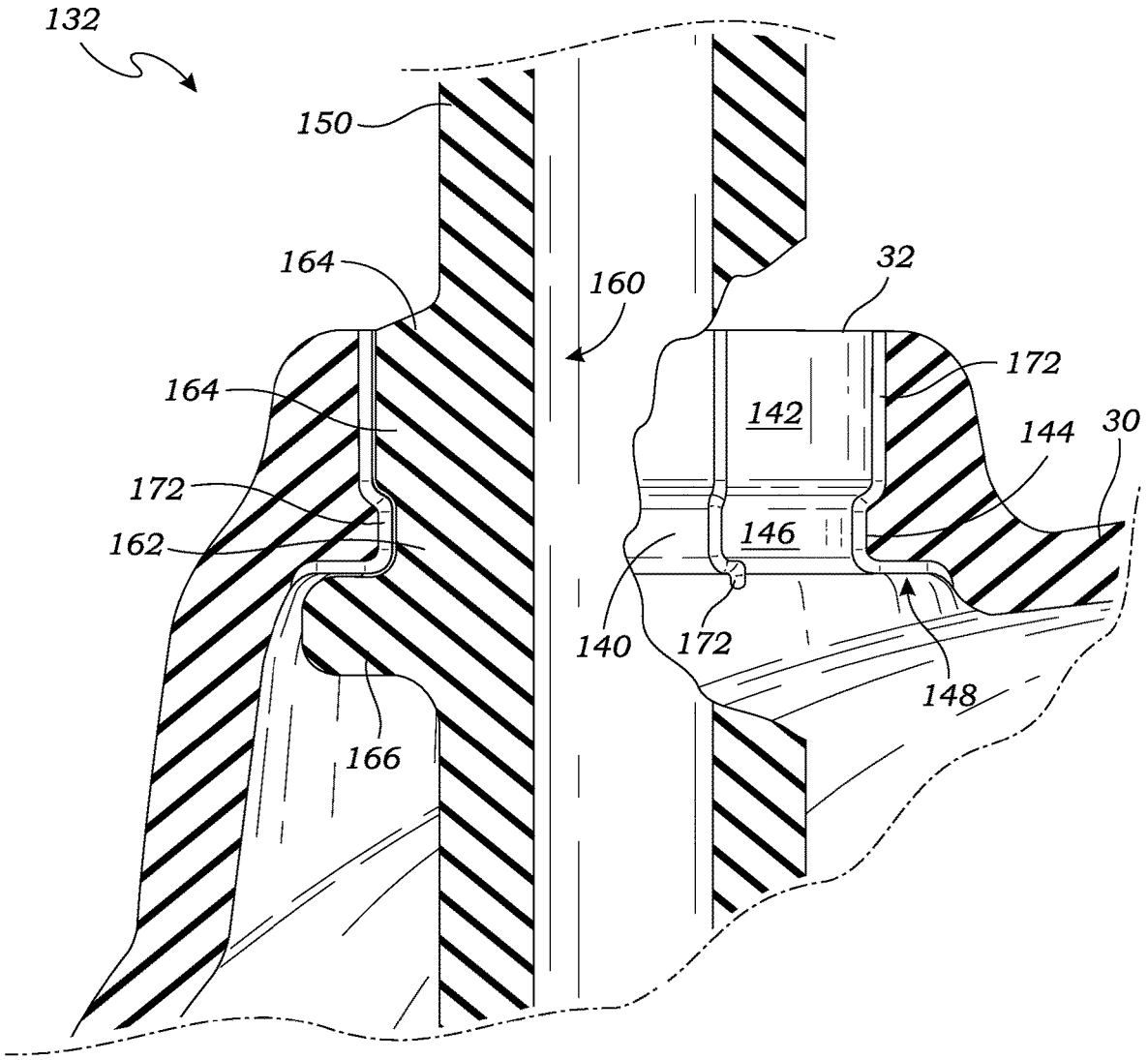
FIG. 8 is a close up cross-sectional view of another embodiment of the combination lid and straw, illustrating venting slots formed in the lid to enable venting through the lid.

FIG. 8 is a close up cross-sectional view of another embodiment of the straw 150 operably mounted in the lid 30, similar to FIG. 7, illustrating an embodiment wherein the venting slots 172 are formed in the lid 30, not the straw 150, to enable venting through the lid 30. In this embodiment, the venting slots 172 extend into the inner surface 140 of the straw aperture 32, including the inner conduit surface 142 and a front surface 146 of the inwardly extending locking portion 144, which fits into and abuts the annular groove 162 of the interlocking portion 160. The venting slots 172 further extend across a lower surface 148 of the inwardly extending locking portion 144. As shown in FIG. 8, the at least one venting slot 172 of this embodiment includes at least three venting slots that are radially spaced from one another.

Figure 9:
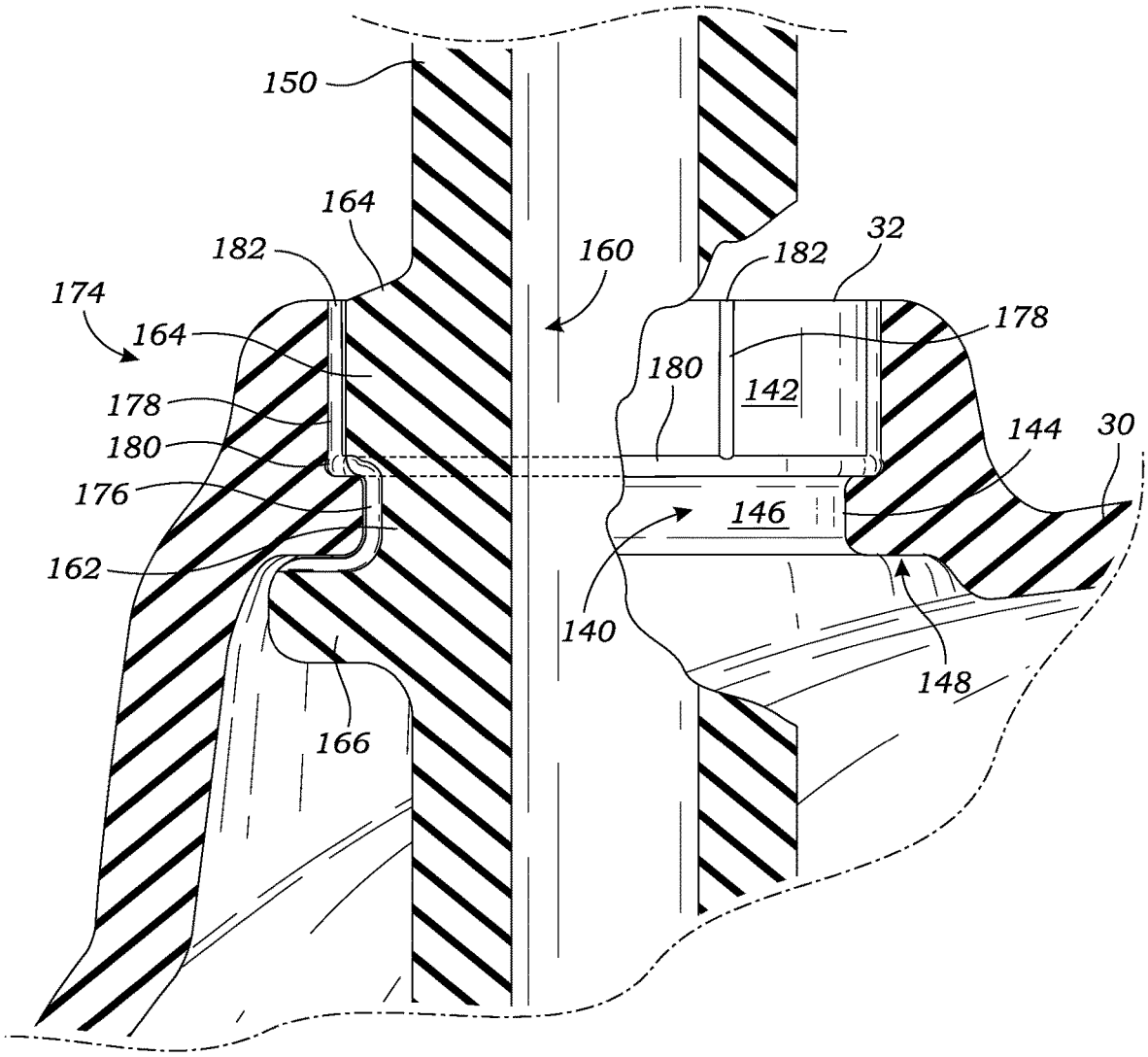
FIG. 9 is a close up cross-sectional view of another embodiment of the combination lid and straw, illustrating venting slots formed through a combination of slot elements formed in both the straw and the straw aperture to enable venting through the lid.

FIG. 9 is a close up cross-sectional view of another embodiment of the straw 150 operably mounted in the lid 30, illustrating venting slots 174 formed through a combination of slot elements formed in both the straw 150 and the straw aperture 32 to enable venting through the lid 30. In this embodiment, each of the venting slots 174 includes a straw vent segment 176 and a lid vent segment 178. In this embodiment, the straw vent segment 176 is formed in the straw 150, in particular in this embodiment in the annular groove 162 and at least some of the bottom bushing portion 166. The lid vent segment 178 in this embodiment is formed in the straw aperture 32, in this embodiment in the inner conduit surface 142.

The straw vent segments 176 and the lid vent segments 178 are operably connected to form the venting slots 174. In the embodiment of FIG. 9, they are operably connected via an annular connector conduit 180 formed in either the lid 30 or the straw 150, or formed in both the lid 30 and the straw 150, such that the annular connector conduit 180 operably connects the straw vent segments 176 with the lid vent segments 178. An advantage of the annular construction of this conduit 180 is that the different segments 176 and 178 do not have to align to operatively interconnect, they can connect from any orientation via the conduit 180.

One advantage of this approach is that only one type of segments (either the straw vent segments 176 or the lid vent segments 178) needs to be formed with precision, the other can be larger and more irregular in shape and size. In this embodiment, the lid vent segments 178, formed in the inner conduit surface 142, is formed with precision, so that the lid vent segments 178 have a diameter that is small enough so that surface tension of water in each of the lid vent segments 178 is enough to prevent leakage from the drinking container. For purposes of this application, the term "prevent leakage" is defined to include complete prevention, and also substantial restriction of leakage so that leakage is so minor during typical usage that it does not bother a typical consumer.

In this embodiment, the lid vent segments 178 each terminate in a critical restriction 182, at which point the diameter of the lid vent segment 178 is small enough so that surface tension of water in each of the lid vent segments 178 is enough to prevent leakage, as discussed above.

Figure 10:
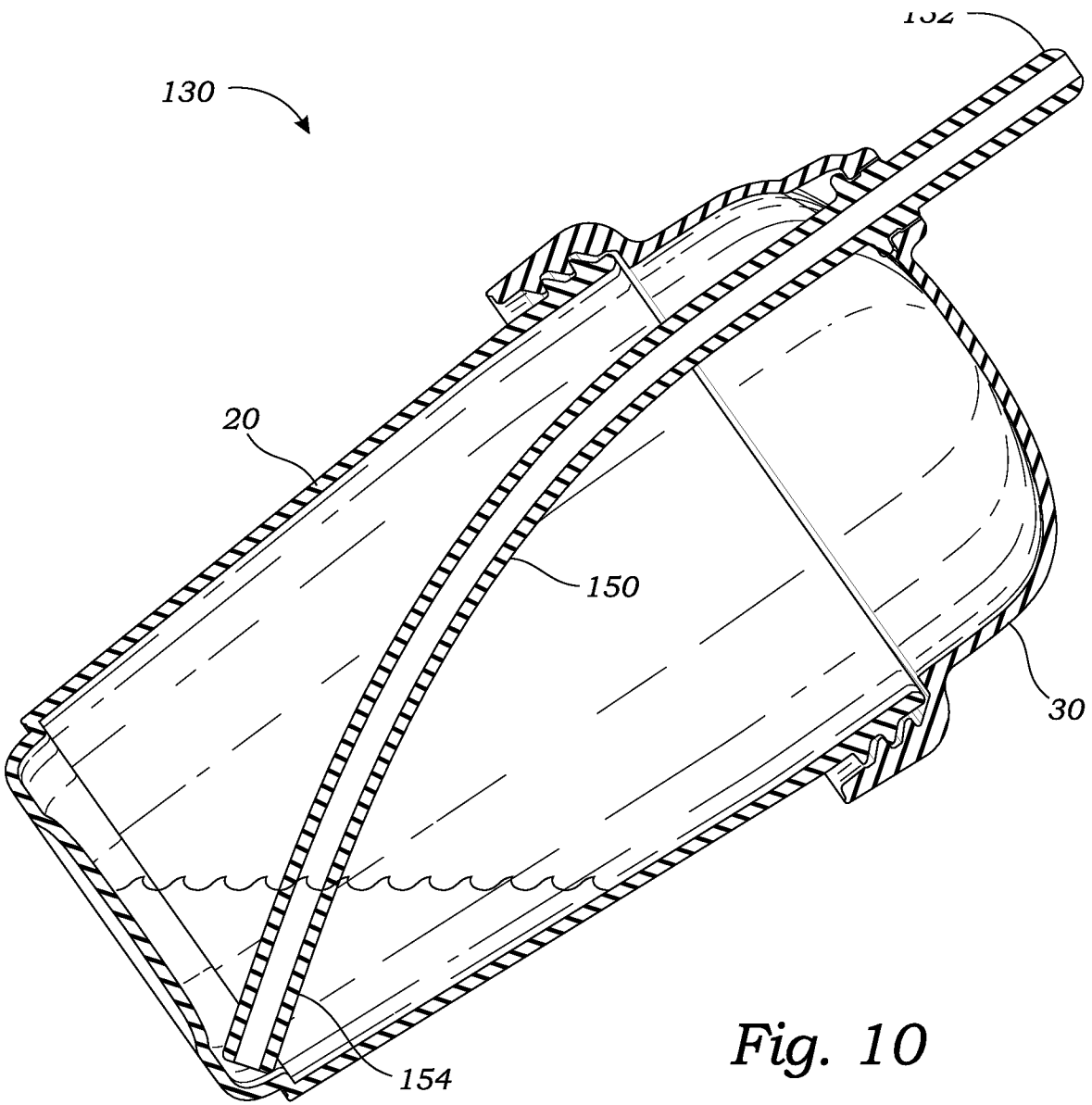
FIG. 10 is a side elevational view of the assembled drinking container of FIG. 6, illustrating the flexing of the drinking straw when the drinking container is held in a non-vertical orientation.

FIG. 10 is a side elevational view of the assembled drinking container 130 of FIG. 6, illustrating the flexing of the drinking straw 150 when the drinking container 130 is held in a non-vertical orientation. In the embodiment of FIG. 10, the straw 150 is constructed of a material that has a specific gravity of greater than 1, such as silicone. In alternative embodiments, other materials may be used, but a specific gravity of greater than 1 may be used in some embodiments to enable the straw 150 to flex and remain submerged, as discussed below.

The elongate straw body has an elastic modulus within a predetermined range such that the combination of the thickness, the diameter, the length, the specific gravity, and the elastic modulus of the straw 150 result in the straw 150 flexing when the container 130 is held in a non-vertical orientation, so that the distal end 154 of the straw 150 remains submerged in the fluid within the container 130, without the addition of weights, as is done in the prior art.

As used in this application, the words "a," "an," and "one" are defined to include one or more of the referenced item unless specifically stated otherwise. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A combination lid and straw for covering a drinking container, the combination comprising:

a lid having a lid perimeter adapted to be attached to the drinking container, the lid having a straw aperture therethrough, the straw aperture having an inner surface, the straw aperture having an inwardly extending locking portion that extends inwardly from the straw aperture;

a straw having a proximal end and a distal end;

an interlocking portion of the straw that includes an annular groove, a top bushing portion, and a bottom bushing portion, wherein the top bushing portion and the bottom bushing portion extend radially outwardly from the straw on either side of the annular groove so that the inwardly extending locking portion of the straw aperture lockingly engages the annular groove between the top bushing portion and the bottom bushing portion;

a plurality of venting slots formed between the inner surface of the straw aperture of the lid, and the outer surface of the straw, each of the venting slots being radially spaced from each other, and longitudinally traversing the inner surface of the straw aperture and the interlocking portion of the straw, including the annular groove as well as the top and bottom bushings; and the plurality of venting slots each having a diameter that is large enough to allow air to vent through the venting slot and into the container, but small enough to restrict liquid from leaking from the container.

2. The combination of claim 1, wherein each of the at least one venting slots is formed in the straw aperture of the lid.

3. The combination of claim 1, wherein the straw aperture includes an inner conduit surface adjacent the inwardly extending locking portion.

4. A combination lid and straw for covering a drinking container, the combination comprising:

a lid having a lid perimeter adapted to be attached to the drinking container, the lid having a straw aperture therethrough, the straw aperture having an inner surface;

a straw having a proximal end, a distal end, and an outer surface;

an interlocking portion of the outer surface of the straw that is shaped to interlock with the straw aperture to resist longitudinal movement of the straw relative to the lid;

wherein the interlocking portion of the straw includes an annular groove, and the straw aperture includes an inwardly extending locking portion that fits within and frictionally engages the annular groove of the interlocking portion of the straw, to removably lock the straw in the straw aperture of the lid;

at least one venting slot formed between the inner surface of the straw aperture of the lid, and the outer surface of the straw, such that each venting slot extends longitudinally across the annular groove and the inwardly extending locking portion; and the at least one venting slot having a diameter that is large enough to allow air to vent through the venting slot and into the container, but small enough such that surface tension prevents leakage from the container.

* * * * *